United States Patent [19]

Fox et al.

[11] 4,181,308

[45] Jan. 1, 1980

[54] ELECTRONIC BACKGAMMON GAME

[76] Inventors: Elinor Fox, 534 Kickerillo Dr.; William Rubinstein, 546 Stoneleigh Dr.; William Hamilton, 435 Hickory Post, all of Houston, Tex. 77079

[21] Appl. No.: 927,457

[22] Filed: Jul. 24, 1978

[51] Int. Cl.[2] ..... A63F 3/02

[52] U.S. Cl. ..... 273/237; 35/8 R; 273/138 A

[58] Field of Search ..... 35/8 R, 8 B; 235/92 GA; 273/1 E, 85 G, 94 R, 138 A, 139, 237; 340/323 R; 364/410, 717

[56] References Cited

U.S. PATENT DOCUMENTS

| | | | |
|---|---|---|---|
| D. 238,289 | 12/1975 | Regensburg | 273/237 X |
| 3,819,186 | 6/1974 | Hinterstocker | 273/237 X |
| 3,838,259 | 9/1974 | Kortenhaus | 364/717 |
| 4,047,008 | 9/1977 | Perkins | 364/717 |
| 4,073,067 | 2/1978 | Beach | 35/8 R |
| 4,087,092 | 5/1978 | Krause et al. | 273/138 A |
| 4,121,830 | 10/1978 | Buckley | 273/138 A |

FOREIGN PATENT DOCUMENTS

| | | | |
|---|---|---|---|
| 1460656 | 10/1966 | France | 273/237 |

OTHER PUBLICATIONS

*Games and Puzzles;* "Gammon Master II;" Mar. 1978, p. 10.

*Primary Examiner*—Vance Y. Hum

*Attorney, Agent, or Firm*—Ostrolenk, Faber, Gerb & Soffen

[57] ABSTRACT

An electronic backgammon game is disclosed. A memory stores m unique sets of dice rolls, each of the m sets of dice rolls includes n sequential rolls and defines a unique game to be played. A game select input is provided for enabling a player to select a desired one of the m sets of dice rolls and thereby to select a unique game to be played. A human actuatable dice roll switch controls the operation of the game. Each time the dice roll switch is reactivated, the next sequential roll in the selected set of dice rolls is displayed on a display board.

13 Claims, 4 Drawing Figures

MICRO PROCESSOR
34
CLOCK
36
RESET PULSE GENERATOR
38
RESET
POWER SOURCE
40
OFF
ON
24
16 WIRES
ADDRESS
DATA
MEMORY
42
CONTROL
44
INTERFACE
47
8 WIRES
BUS
45
4 WIRES
BCD TO 7 SEGMENT DECODER/ DRIVER
46
BCD TO DECIMAL DECODER/ DRIVER
48
16 TO 4 ENCODER
50
KEYBOARD
22
32
20
14
16
18

ELECTRONIC BACKGAMMON GAME

BACKGROUND OF THE INVENTION

Backgammon, one the oldest games in the world, has become increasingly popular in the United States over the last several years. Both skill and chance are the primary elements in a standard backgammon game. While each player pits his skill against that of his opponent, chance remains a primary factor in the outcome of the game. Thus, while the player's strategy can increase or decrease his chance of winning, the outcome of the game is, to a large degree, based upon the luck of the dice roll.

A primary object of the present invention is to remove the element of luck from the backgammon game. When the element of chance is so removed, each player can directly assess his skill with respect to one or more remaining players.

Another object of the present invention is to provide an electronic backgammon game which enables a player to recall any one of a given plurality of unique sets of dice rolls at will. Another object of the present invention, is to provide a small, hand-held game which utilizes computer technology to obtain the foregoing and other objects of the invention which will become apparent from the following description of the invention.

BRIEF DESCRIPTION OF THE INVENTION

The foregoing and other objects of the present invention are achieved by providing an apparatus which both stores a plurality of preset sequences of dice rolls and permits each of the rolls in any desired sequence to be sequentially displayed responsive to the actuation of a player actuated dice roll switch. In this manner, the sequence of dice rolls in each set of dice rolls is fixed and can be recalled at will. By having several sets of players play the same sequence of rolls, the relative scores of each player will provide an indication of each players skill with respect to the remaining players. Since each set of plyers have played the same sequence of rolls, the element of luck is removed from the scores and a true indication of each players ability is provided.

The apparatus according to the invention utilizes a stored memory of m backgammon games; preferably 999 games. Each backgammon game consists of n, preferably 64, preprogrammed unchangeable simulated throws of dice. To each user of the apparatus, the sequence of throws of the dice in each game appears to be random. Every person operating the apparatus in a particular selected game will experience the same dice tosses. The relative abilities of the players faced with the same backgammon game situation can thereby be assessed.

The game is preferably housed in a small hand-held unit which includes a plurality of display panels and a control keyboard. Separate display panels are preferably provided for indicating the game selected, the sequential dice roll and the toss number of that dice roll. The control keyboard includes a plurality of pushbutton switches which enable a player to select the game to be played and to sequentially display each of the m sequential rolls in the selected game. After selecting the desired game to be played, the player depresses a toss pushbutton each time he wishes to display the next roll in the sequential set of rolls of the selected game. The electronic game is preferably reduced to one or two microelectronic chips rather than the large number described. This is done to reduce both cost and power consumption.

DETAILED DESCRIPTION OF THE INVENTION

Figure 1:
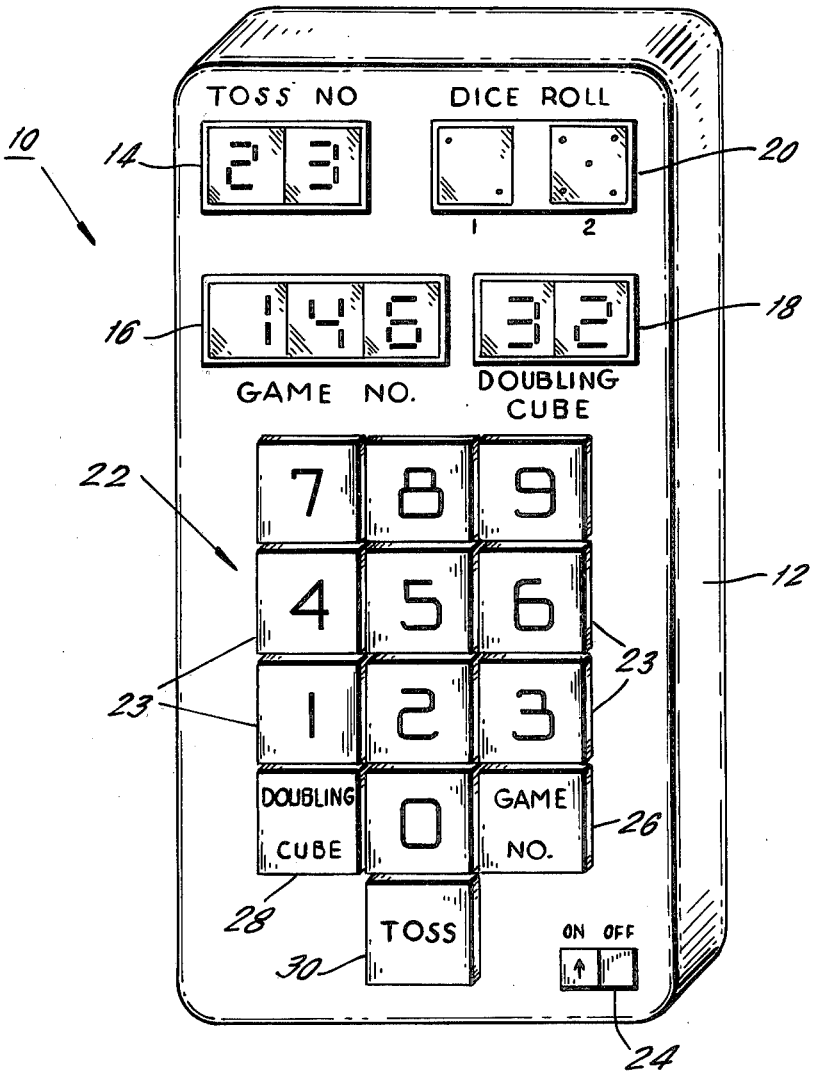
FIG. 1 is a perspective view of a hand-held electronic backgammon game constructed in accordance with the principles of the present invention.

Referring now to the drawings wherein like numerals indicate like elements, there is shown in FIG. 1 an electronic backgammon game constructed in accordance with the principles of the present invention and designated generally as 10. Backgammon game 10 is preferably housed in a housing 12 which is preferably in the shape of a handheld or pocket calculator. The housing 10 may be formed of plastic or any other suitable material.

The upper face of housing 12 includes a plurality of display panels 14, 16, 18 and 20, a keyboard 22 and an on/off switch 24. Keyboard 22 includes a plurality of number keys 23 representing the arabic numerals 0 through 9, a game number key 26, a doubling cube key 28 and a toss key 30. The function of these switches will be described below.

On/off switch 24 is preferably a slidable, two position switch which connects each of the electric elements of the game 10 to a power source housed in the housing 12 when the switch 24 is placed in the ON position. Display panels 14 through 18 include a plurality of visual display devices, which are preferably seven segment LED displays, for example Monsanto MAN 1 displays. Display panel 20 also includes a plurality of visual display devices which are preferably 7 segment LEDs which may be selectively activated to display any one of the faces on a standard die. In these displays, each segment represents a different spot on a standard die face.

Figure 2:
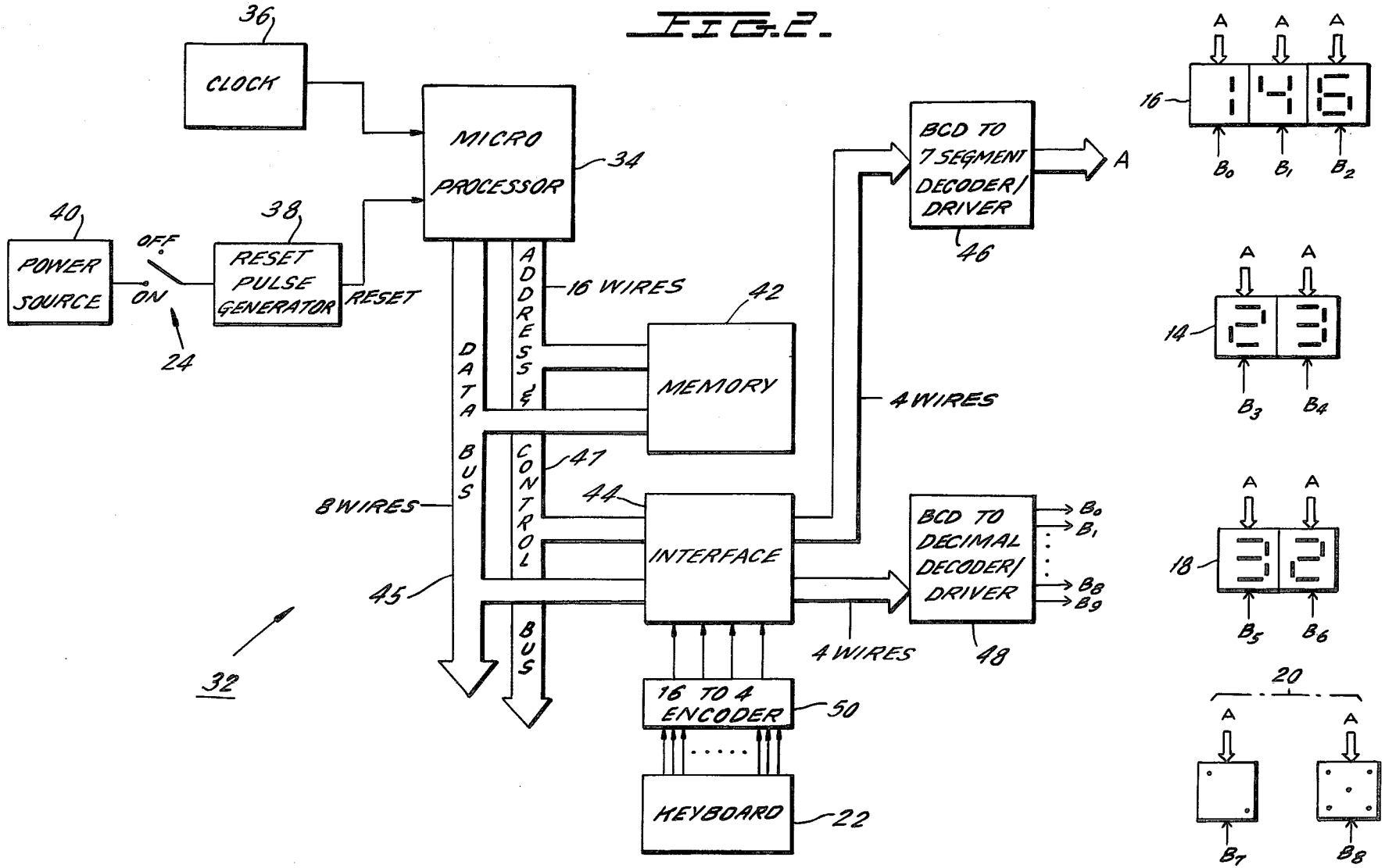
FIG. 2 is a block diagram of the control circuitry for the backgammon game of FIG. 1.

An electronic circuit which interfaces keyboard 22 and display panels 14 through 20 is illustrated in FIG. 2. The heart of circuit 32 is a microprocessor 34 which may be a Motorola MC6800 microprocessor. The structure and operation of microprocessors are well knwon in the art and will not be described in detail herein. Such structure and operation is described in detail in Ward Microprocessor/Microprogramming Handbook, Tab Books (1975). The information set forth in the foregoing publication is incorporated herein by reference. Additional literature concerning the Motorola microprocessor MC6800 is available from Motorola Semiconductor Products, Inc.

Figure 3A:
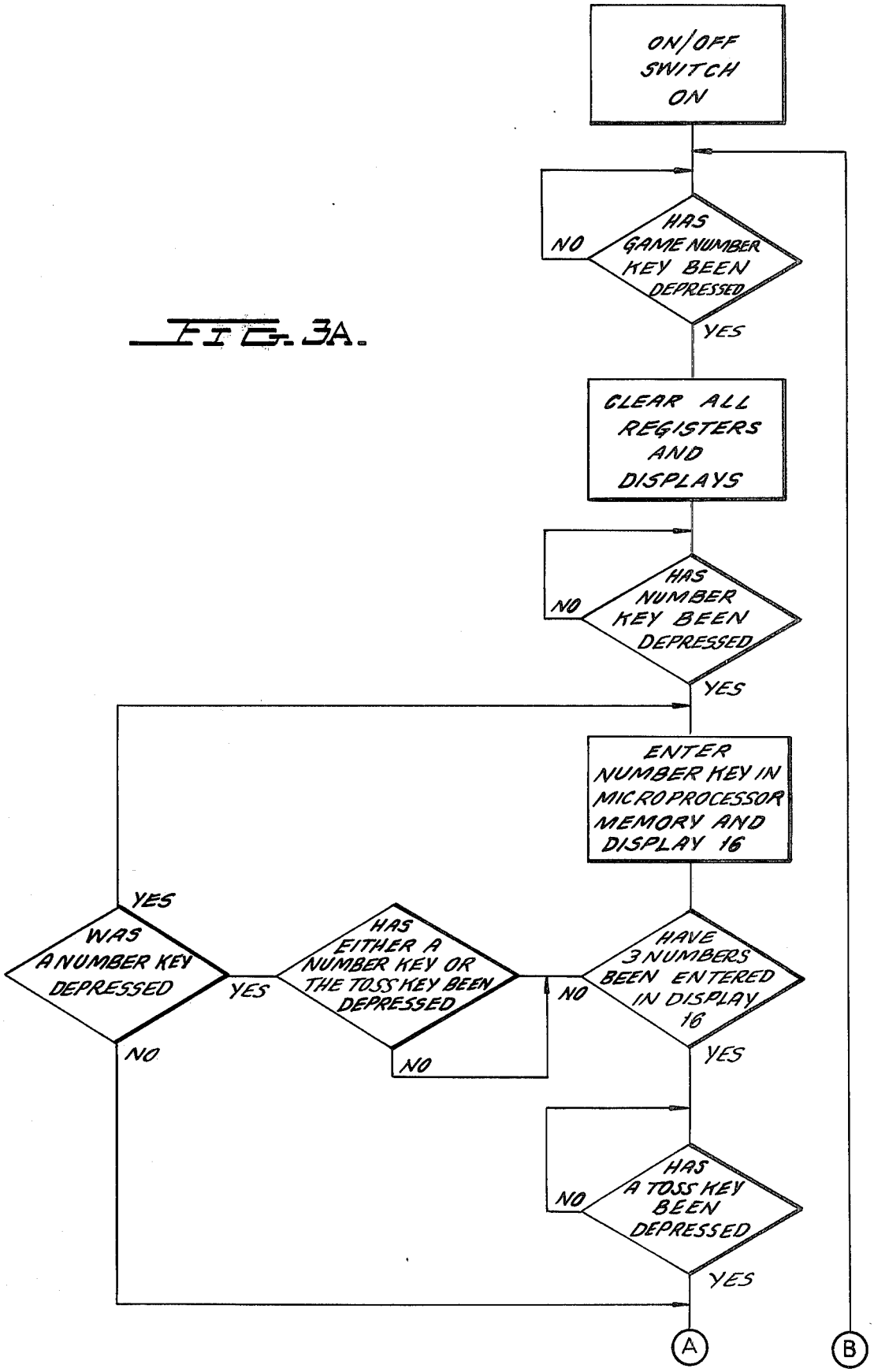
FIGS. 3A and 3B illustrate a flow diagram of the operation of the control circuitry of FIG. 2.
Figure 3B:
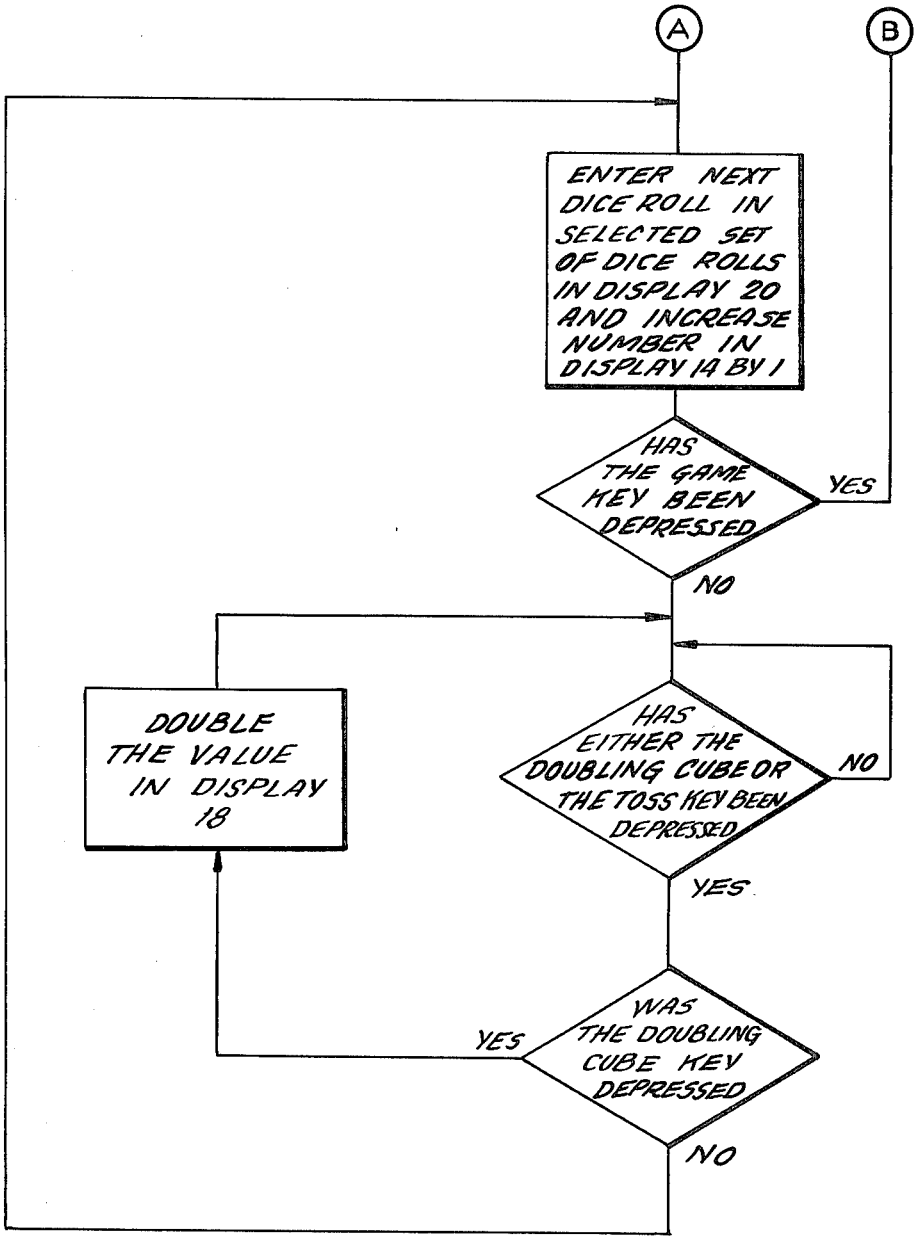

Microprocessor 34 is fed by a clock pulse generator 36 and a reset pulse generator 38. Clock pulse generator 36 may be a Motorola MC6870A clock and operates the microprocessor at the desired frequency. The reset pulse generator 38 is connected to a power source 40 through on/off switch 24. Pulse generator 38 is perferably a monostable multivibrator and generates a reset pulse at its output each time switch 24 is moved into the ON position. The reset pulse generated by pulse generator 38 is applied to microprocessor 34 and causes the microprocessor to start operation of game 10 at the beginning of the computer program controlling the microprocessor. A flow diagram of the computer program is illustrated in FIGS. 3A and 3B and described below. In addition to supplying reset pulse generator 38, power source 40 supplies each of the electrical elements of circuit 32. The actual connection between these elements and power source 40 has not been shown for simplicity.

Microprocessor 34 communicates with a memory 42 and an interface circuit 44 via a data bus 45 and an address control bus 47. Memory 42 is preferably a read only memory and contains both the computer program and a fixed file of preferably 999 unique sets of dice rolls. Each set of dice rolls defines a unique game to be played and contains a plurality of sequential rolls, each roll defining a pair of dice. In a preferred embodiment, each set of dice rolls contains 64 sequential rolls. In the following discussion, it will be assumed that the game stores 999 unique sets of dice rolls and that each set of dice rolls includes 64 sequential rolls. It should be understood, however, that the invention is not restricted to these particular numbers and that any number m unique sets of dice rolls may be provided and that any number n sequential rolls may be provided in each set of rolls. As used herein, the terms "m" and "n" refer to positive integers greater than 1.

While the 999 unique sets of devices are preferably stored in a read only memory, the sets of dice rolls may be generated by a pseudo random number generator such as that described in Goolomb, *Digital Communications With Space Applications,* Prentice-Hall (1964). Generally, any type of algorithm may be utilized to generate a repeatable series of random numbers whether by precalculated file or any type of random number generator that can be initialized at a specific point for each game called. As used, the term "memory" includes both a standard memory device (such as a read only memory) and pseudo random number generator devices such as those described above.

Interface circuit 44, which may be a Motorola MC6820, enables the microprocessor 34 to communicate with keyboard 22, decoder/driver 46 and decoder/driver 48. A latch can be added to decoder/driver 46 to maintain uniform brightness. The computer program causes the microprocessor 34 to periodically scan interface circuit 44 to detect if there have been any new entries into keyboard 22. As shown in FIG. 1, keyboard 22 has thirteen key inputs. Each of these inputs are applied to a 16 to 4 wire encoder 50 which reduces the sixteen inputs into a coded 4-bit word representative of the key last actuated. This signal is applied to interface circuit 44 and decoded by the microprocessor 34.

BCD to seven segment decoder/driver 46, which may be a Texas Instrument SN7447A, accepts a 4-bit binary-coded-decimal (BCD) signal generated by interface circuit 44 and decodes this signal into a 7-bit output which is applied to each of the display panels 14 through 16. BCD is decimal decoder/driver 48, which may also be a Texas Instrument SN7447A, generates a gating signal at one of its outputs $B_0$ through $B_9$ in accordance with a second BCD signal generated by interface circuit 44. Each of the outputs of decoder/driver 48 is connected to a different one of the LEDs defining display panels 14 through 20 such that only one of the LEDs receives a gating signal from decoder/driver 48 at any given time. Microprocessor 34 coordinates the timing of the outputs of drivers 46 and 48 in such a manner that each time a given LED has its respective gating signal $B_0$ through $B_9$ applied thereto, the output A of decoder/driver 46 corresponds to the desired output of that LED.

The operation of game 10 will now be described with reference to FIGS. 1 and 2. The sequence of program operations are illustrated in flow diagram form in FIGS. 3A and 3B. While particular reference will not be made to these flow diagrams, it will be helpful to the reader of this specification to make general reference thereto.

In the normal sequence of operations, the computer program is initiated by placing on/off switch 24 into its ON position so as to cause pulse generator 38 to apply a reset pulse to microprocessor 34. This causes the microprocessor 34 to start operation at the beginning of the computer program. Microprocessor 34 will continuously scan interface circuit 44 until it detects that game number key 26 has been depressed. When this signal has been detected, microprocessor 34 clears all registers and sets all displays to 0. At this point, microprocessor 34 again scans interface circuit 44 to detect if a number key 23 has been depressed. When a number key depression is detected, microprocessor 34 stores the number of the depressed key in its memory banks and generates an output signal which causes interface circuit 44 to apply the necessary BCD signals to decoder/drivers 46 and to cause the last numbered key 23 entered to be displayed in the right hand LED of game number display 16. For example, if the number key 23 which corresponds to the arabic numeral 2 is depressed, the number 2 is stored in the memory bank of the microprocessor and the number 2 is displayed in the right hand LED of game number display 16.

At this point, the microprocessor determines if three numbers have been entered into the display 16. If three numbers have been entered, microprocessor 34 scans interface circuit 44 to determine if the toss key 30 has been depressed. If less than three numbers have been entered into the display 16, the microprocessor 34 scans interface 44 to determine if either a number key 23 or the toss key 30 is depressed. If a number key 23 has been depressed, the microprocessor stores the number in its memory bank and generates an output signal which causes the interface circuit 44 to apply the necessary BCD signals to decoder/drivers 46 and 48 to cause the number last entered into keyboard 22 to be displayed in the right-hand LED of display 16. At the same time, microprocessor 34 causes each of the digits previously illustrated in display 16 to move one place to the left. This process is repeated until three numbers have been entered into display 16 or until the toss key 30 is depressed.

When toss key 30 is depressed, microprocessor 34 appropriately addresses memory 42 and interface 44 to cause the first dice roll of the set of dice rolls selected by the operator of the game to be displayed on display 18. Microprocessor 34 also generates an output signal which will cause the number 1 to be displayed in toss number display 14. The numbers displayed in toss number display 14 indicates that the dice roll illustrated in dice roll display 20 is the first roll in the preselected set of rolls. The number in game number display 16 indicates which set of rolls has been selected.

After entering the dice roll in display 20 and the toss number in display 14, the microprocessor determines if the game key has been depressed. If it has been depressed, the microprocessor reinitiates operation of the game at the beginning of the computer program. If the game key was not depressed the microprocessor scans interface 44 to determine if either the doubling cube key or the toss key is depressed. If the microprocessor determines that the doubling cube key has been depressed, it doubles the value of the number appearing in doubling display cube 18. If microprocessor 34 determines that the toss key has been depressed, it enters the next dice roll in the selected set of dice rolls in display 20 and increases the number in toss number display 14 by one. This process is repeated until the game of play is completed.

The operation of a typical game of backgammon utilizing game 10 will now be described. At the initiation of a game, on/off switch 23 is placed in the on position and each of the displays 14 through 20 are cleared. The game number switch 26 is depressed and a game number (between 1 and 999) is entered into the keyboard 22. The number so entered is displayed on the game number display 16 and represents the stored sequence of dice throws (i.e. the game) which the player desires to play. At this point, the first player (hereinafter the North player) depresses the toss switch 30 and the first throw in the selected sequence of dice throws will appear on dice display 20. Simultaneously, the number 1 displayed in the toss number display 14. After the North player has moved his men in accordance with the dice roll, the second player (hereinafter after the South player) depresses the toss switch 30 and the second dice roll in a selected game will be displayed. Simultaneously, the number in toss number display increases to two.

After the South player has made his move, the North player again depresses the toss switch 30 causing the third dice roll in the selected game to be displayed and causing the toss number display 14 to increase to three. After either player completes his move, the other player may depress the doubling cube 28 to increase the value displayed in doubling cube display 18. After the doubling cube has been depressed, the opposite player may accept or reject the double. If accepted, he depresses the toss key and the game continues. If rejected, the game is completed and a new game can be selected. The foregoing sequence is repeated until either player removes all of his men from the board. A new game may then be selected by depressing the game key. At this point, a new game number is entered in the manner described above and the entire process is repeated. The players can either select the same game number and continue from the first toss in that number or can select an entirely new game number. It is also possible to begin play somewhere in the middle of any game by merely selecting the game number and pressing the toss button 30 a desired number of times before the players actually play the particular dice roll displayed on display 20.

The present invention may be embodied in other specific forms without departing from the spirit or essential attributes thereof and, accordingly, reference should be made to the appended claims, rather than to the foregoing specification as indicating the scope of the invention.

What is claimed is:

1. An electronic backgammon game, comprising:

memory means for storing m unique sets of dice rolls, each of said m sets of dice rolls including n sequential rolls and defining a unique game to be played;

game select means for selecting a desired one of said m sets of dice rolls and thereby selecting a unique game to be played;

a human actuatable dice roll switch;

dice roll display means for sequentially displaying each of said n sequential rolls in said selected set of dice rolls, said control means to display the next sequential roll in said selected set of dice rolls each time said dice roll switch is reactived.

2. The game of claim 1, further including game display means for providing a visual indication of the unique game to be played.

3. The game of claims 1 or 2 further including toss number display means for indicating which of said n rolls of said selected set of dice rolls is displayed by said dice roll display means.

4. The game of claim 3 further including doubling cube means for displaying a two digit number selected by a player.

5. The game of claim 4, wherein said doubling cube means comprises:

a doubling cube display panel;

human actuatable means for doubling the number shown on said display panel each time it is reactuated until the number shown on said display panel reaches a predetermined value.

6. The game of claim 1 wherein said dice roll display means comprises:

a dice roll display panel; and control means for sequentially removing each of said n sequential rolls in said selected set of rolls from said memory means and displaying said removed roll on said display panel, said control means to remove the next sequential roll in said selected set of rolls, and to display that roll on said display panel, each time said dice roll switch is reactivated.

7. The game of claim 6 wherein said control means includes a microprocessor.

8. The game of claim 1 wherein said game select means includes a human actuatable means for permitting a player to select the unique game to be played.

9. The game of claim 8 wherein said human actuatable means includes a plurality of push button switches.

10. An electronic backgammon game, comprising:

a memory means for storing m unique sets of dice rolls, each of said m unique sets of dice rolls including n sequential rolls and defining a unique game to be played;

human operable game select means for generating a first signal indicative of a selected one of said m sets of dice rolls and therefor a selected game to be played;

a human actuatable dice roll switch;

dice roll display means for displaying each of said n sequential rolls in said selected set of rolls, said dice roll display means to display the next sequential roll in said selected set of rolls each time said dice roll switch is reactivated;

game display means for indicating the unique game selected;

toss number display means for indicating which of said n rolls of said selected set of rolls is displayed by said dice roll display means.

11. The game of claim 10 further including a doubling cube means which comprises:

a doubling cube display panel;

human actuatable means for doubling the number shown on said display panel each time it is reactuated until the number shown on said display panel reaches a predetermined value.

12. The game of claim 11 wherein said dice roll display means comprises:

a dice roll display panel; and control means for sequentially removing each of said n sequential rolls in said selected set of rolls from said memory means and displaying said removed roll on said display panel, said control means to remove the next sequential roll in said selected set of rolls, and to display that roll on said display panel, each time said dice roll switch is reactivated.

13. The game of claim 11 wherein said memory means is a random number generator which can be initialized for each game called.

* * * * *